US011837795B2

(12) United States Patent
Liu et al.

(10) Patent No.: US 11,837,795 B2
(45) Date of Patent: Dec. 5, 2023

(54) SLIDER, PHASE SHIFTER AND BASE STATION ANTENNA

(71) Applicant: CommScope Technologies LLC, Hickory, NC (US)

(72) Inventors: Jian Liu, Suzhou (CN); Long Shan, Suzhou (CN)

(73) Assignee: CommScope Technologies LLC, Claremont, NC (US)

( * ) Notice: Subject to any disclaimer, the term of this patent is extended or adjusted under 35 U.S.C. 154(b) by 78 days.

(21) Appl. No.: 17/510,658

(22) Filed: Oct. 26, 2021

(65) Prior Publication Data

US 2022/0140480 A1 May 5, 2022

(30) Foreign Application Priority Data

Oct. 30, 2020 (CN) ..... 202011186628.7

(51) Int. Cl.

| | |
|---|---|
| ***H01Q 3/30*** | (2006.01) |
| ***H01Q 3/34*** | (2006.01) |
| ***H01Q 1/24*** | (2006.01) |
| ***H01Q 3/32*** | (2006.01) |
| ***H01Q 21/26*** | (2006.01) |

(52) U.S. Cl.

CPC ..... *H01Q 3/34* (2013.01); *H01Q 1/246* (2013.01); *H01Q 3/32* (2013.01); *H01Q 21/26* (2013.01)

(58) Field of Classification Search

CPC ..... H01Q 1/22; H01Q 1/246; H01Q 3/26; H01Q 3/30; H01Q 3/34; H01Q 3/32; H01Q 21/26; H01Q 3/36

See application file for complete search history.

(56) References Cited

U.S. PATENT DOCUMENTS

| | | | | |
|---|---|---|---|---|
| 7,170,466 | B2 * | 1/2007 | Janoschka | H01P 1/184 343/882 |
| 10,476,120 | B2 * | 11/2019 | Kim | H01Q 3/36 |
| 10,498,028 | B2 * | 12/2019 | Xiao | H01Q 3/36 |
| 11,450,956 | B2 * | 9/2022 | Jang | H01Q 1/325 |
| 2009/0189826 | A1 * | 7/2009 | Timofeev | H01Q 3/32 343/853 |

(Continued)

FOREIGN PATENT DOCUMENTS

| | | | |
|---|---|---|---|
| CN | 102377024 A | * | 3/2012 |
| CN | 109713406 A | * | 5/2019 |
| CN | 210489788 U | | 5/2020 |

(Continued)

OTHER PUBLICATIONS

"Notification of Transmittal of the International Search Report and the Written Opinion of the International Searching Authority, or the Declaration for corresponding International Application No. PCT/US2021/056399, dated Feb. 11, 2022, (22 pages)".

*Primary Examiner* — Blane J Jackson
(74) *Attorney, Agent, or Firm* — Myers Bigel, PA

(57) ABSTRACT

A slider includes: a first coupling section; a second coupling section; and an impedance conversion line, which is connected between the first coupling section and the second coupling section, and includes a series portion and a parallel portion connected in series, wherein the series portion includes only one first connection line, and the parallel portion includes at least two second connection lines connected in parallel.

20 Claims, 5 Drawing Sheets

(56) References Cited

U.S. PATENT DOCUMENTS

| | | | | |
|---|---|---|---|---|
| 2015/0200467 | A1* | 7/2015 | Kurk | H01Q 1/241<br>343/853 |
| 2020/0321697 | A1* | 10/2020 | Zimmerman | H01Q 21/26 |

FOREIGN PATENT DOCUMENTS

| | | | | |
|---|---|---|---|---|
| JP | 2004521542 | A | * | 7/2004 |
| WO | 2019178224 | A1 | | 9/2019 |

* cited by examiner

SLIDER, PHASE SHIFTER AND BASE STATION ANTENNA

CROSS-REFERENCE TO RELATED APPLICATION

The present application claims priority to Chinese Patent Application No. 202011186628.7, filed Oct. 30, 2020, the entire content of which is incorporated herein by reference as if set forth fully herein.

FIELD

The present disclosure relates to the field of communication technology, and in particular, to a slider, a phase shifter, and a base station antenna.

BACKGROUND

Base station antennas typically include one or more arrays of antenna elements that are used to transmit and receive radio frequency (RF) signals. For example, a base station antenna may include a column or "linear array" of antenna elements. An RF signal may be divided into a plurality of sub-components, and the sub-components may be fed to the respective antenna elements in the linear array for transmission. The RF energy radiated by the antenna elements forms an antenna beam. Each array of antenna elements may be designed to generate antenna beams that have relatively low sidelobe levels, which acts to increase the gain of the antenna beam within a sector served by the base station antenna, and to reduce the amount of interference that the antenna beam causes in adjacent sectors and/or cells. The levels of the sidelobes of an antenna beam can be reduced by applying a relatively large magnitude taper across the antenna elements of the array, meaning that there are relatively large differences in the magnitudes of the sub-components that are fed to different antenna elements of the array. For example, with a linear array, the magnitudes of the sub-components that are fed to antenna elements in the center of the array are relatively large, and the magnitudes of the sub-components fed to other antenna elements decrease with increasing distance from the center of the linear array.

Most modern base station antennas include phase shifters that may be used to adjust the pointing direction of the antenna beams formed by the respective arrays. The phase shifters are designed to (1) split an RF signal input thereto into a plurality of sub-components and (2) applying an adjustable phase taper to the sub-components of the RF signal that are fed to the antenna elements of the array. The above-discussed phase shifters are often implemented as electromechanical phase shifters that include a moveable element such as a so-called "slider" (e.g., a wiper arm) that can be adjusted to adjust the amount of the phase shift that is applied. The slider In conjunction with a stationary component of the phase shifter) may include a power divider circuit that sub-divides an RF signal that is input to the slider into a plurality of sub-components. The slider may include a transmission line structure that is referred to as an impedance conversion line that. As the impedance of such an impedance conversion line increases, the magnitude taper that is applied to the sub-components of the RF signals increases accordingly. In general, the impedance can be adjusted by changing the line width of the impedance conversion line. However, if the line width is too narrow, it may become a source of passive intermodulation distortion, may increase the risk that some sub-components may have power levels that are too high, and may also result in manufacturing difficulties.

SUMMARY

According to a first aspect of the present disclosure, a slider is provided, and the slider includes: a first coupling section; a second coupling section; and an impedance conversion line, which is connected between the first coupling section and the second coupling section, and includes a series portion and a parallel portion connected in series, wherein, the series portion includes only one first connection line, and the parallel portion includes at least two second connection lines connected in parallel.

According to a second aspect of the present disclosure, a phase shifter is provided, and the phase shifter includes: a fixing member; and the slider as described above, which is slidably connected to the fixing member.

According to a third aspect of the present disclosure, a base station antenna is provided, and the base station antenna includes the slider as described above or the phase shifter described above.

Through the following detailed descriptions of exemplary embodiments of the present disclosure by the accompanying drawings, other features and advantages of the present disclosure will become clearer.

BRIEF DESCRIPTION OF THE DRAWING

FIG. 6(*b*) is a diagram showing the power distribution of a phase shifter including the slider in FIG. 3.

FIG. 7(*b*) is an azimuth pattern showing radiation signals of a base station antenna including the slider in FIG. 3.

Figure 1:
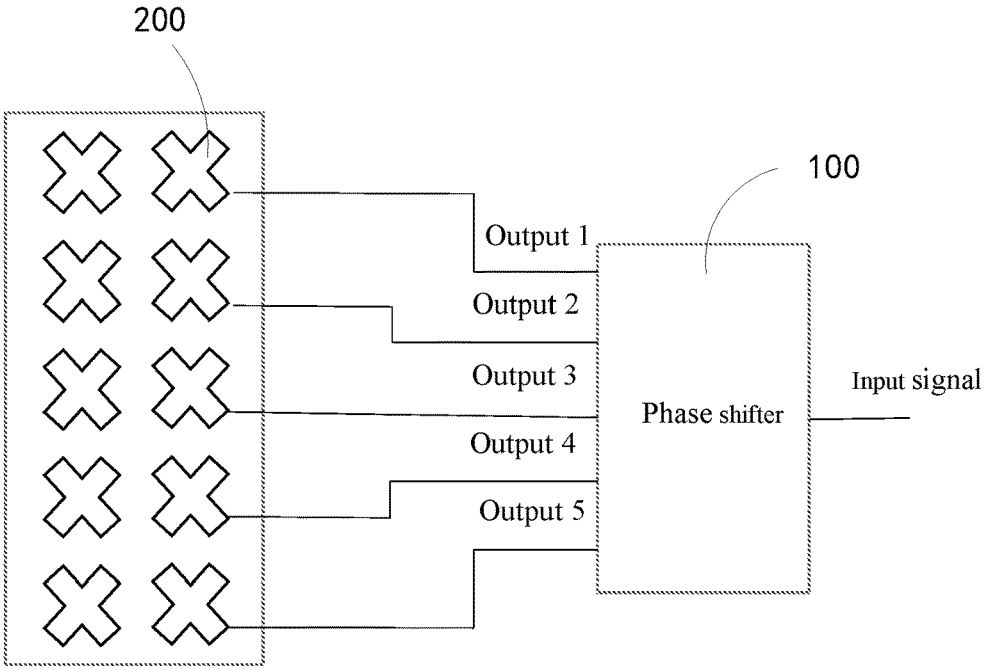
FIG. 1 is a schematic block diagram showing a base station antenna according to an exemplary embodiment of the present disclosure.

Note that in the embodiments described below, the same signs are sometimes used in common between different drawings to denote the same parts or parts with the same functions, and repeated descriptions thereof are omitted. In some cases, similar labels and letters are used to indicate similar items. Therefore, once an item is defined in one figure, it does not need to be further discussed in subsequent figures.

For ease of understanding, the position, dimension, and range of each structure shown in the drawings and the like may not indicate the actual position, dimension, and range. Therefore, the present disclosure is not limited to the positions, dimensions, and ranges disclosed in the drawings and the like.

Parts shown by dotted lines in the drawings may be blocked by other parts in the viewing angles of the drawings.

DETAILED DESCRIPTION

Various exemplary embodiments of the present disclosure will be described in detail below with reference to the accompanying drawings. It should be noted: unless otherwise specifically stated, the relative arrangement, numerical expressions and numerical values of components and steps set forth in these embodiments do not limit the scope of the present disclosure.

The following description of at least one exemplary embodiment is actually only illustrative, and in no way serves as any limitation to the present disclosure and its application or use. In other words, the structure and method herein are shown in an exemplary manner to illustrate different embodiments of the structure and method in the present disclosure. Those of ordinary skill in the art should understand that these examples are merely illustrative, but not in an exhaustive manner, to indicate the embodiments of the present disclosure. In addition, the drawings are not necessarily drawn to scale, and some features may be enlarged to show details of specific components.

The technologies, methods, and equipment known to those of ordinary skill in the art may not be discussed in detail, but where appropriate, the technologies, methods, and equipment should be regarded as part of the specification.

In all examples shown and discussed herein, any specific value should be construed as merely exemplary value and not as limitative value. Therefore, other examples of the exemplary embodiment may have different values.

As discussed above, in a base station antenna, as shown in FIG. 1, a phase shifter 100 may divide an RF signal input thereto into a plurality of sub-components, and may apply a phase taper across those sub-components. FIG. 1 illustrates a base station antenna having a phase shifter 100 that divides RF signals input thereto into five output sub-components, that are output at output 1 through output 5, and applies a phase taper so that the phase difference between every two adjacent output signals in the output 1, output 2, output 3, output 4, and output 5 may be equal to each other. Output 1, output 2, output 3, output 4, and output 5 are passed to respective antenna elements 200 of an array (here the linear array comprising the antenna elements in the right-side column) to drive the antenna elements 200 to generate an antenna beam. It should be understood that in other embodiments, the phase shifter 100 may also convert an input signal into another number of output signals.

In order to reduce the sidelobe levels of the antenna beams generated by an array of antenna elements of the base station antenna, the amplitude of the sub-components of the RF signal that are fed to the antenna elements 200 that are at the ends of the linear array may be configured to be smaller than the amplitudes of the sub-components of the RF signal that are fed to the antenna elements 200 that are closer to the center of the linear array. In other words, the amplitudes of the sub-components of the RF signal that are output at output 1 and output 5 of the phase shifter 100 should be lower than the amplitudes of the sub-components of the RF signal that are output at output 2, output 3, and output 4, so that most of the energy of the radiation signal generated by the base station antenna can be concentrated in the main lobe of the antenna beam.

Figure 2:
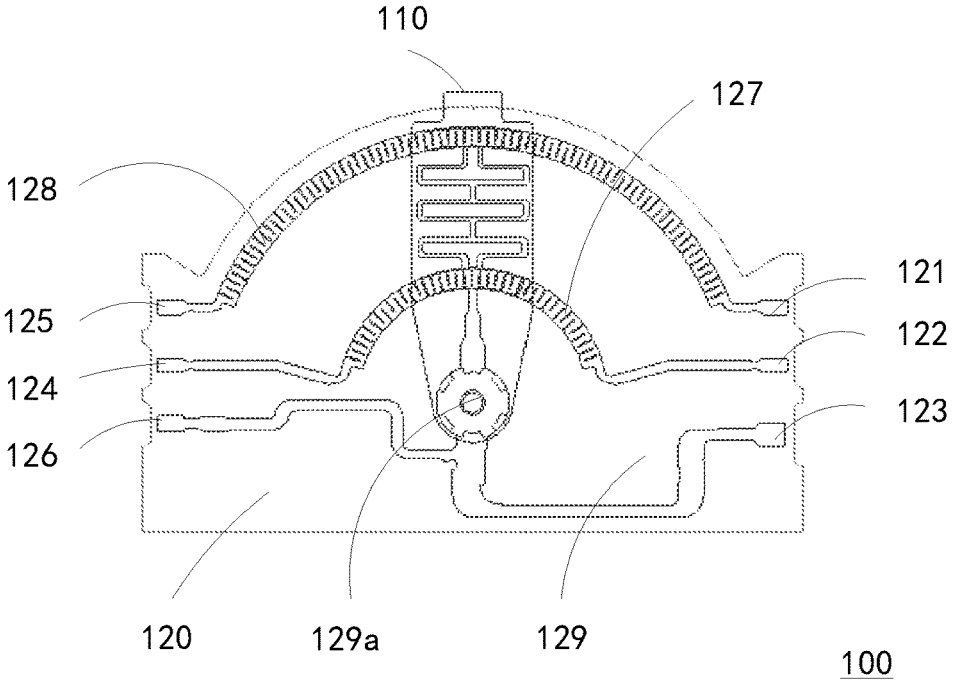
FIG. 2 is a schematic structural diagram showing a phase shifter according to an exemplary embodiment of the present disclosure.

A phase shifter 100 according to an exemplary embodiment of the present disclosure is shown in FIG. 2. The phase shifter 100 may include a slider 110 and a stationary member 120, where, the slider 110 is slidably connected to the stationary member 120. When the position of the slider 110 relative to the stationary member 120 changes, the phase of each output signal output by the phase shifter 100 will change accordingly, which allows the downtilt angle of the antenna beam that is generated by the array of the base station antenna to be changed.

In some embodiments, the stationary member 120 may be a printed circuit board. As shown in FIG. 2, the stationary member 120 may include a second substrate 129, and a second connection hole 129*a* may be provided on the second substrate 129. The stationary member 120 may further include a first transmission line 127 and a second transmission line 128 that are provided on the second substrate 129 The first transmission line 127 and the second transmission line 128 may comprise, for example, microstrip transmission lines that comprise conductive traces on a first side of the second substrate 129 and a metal ground plane (not shown) on an opposed second side of the second substrate 129. The stationary member 120 further includes an input port 126 for receiving input signals, and output ports 121, 122, 123, 124, and 125 for outputting output signals, wherein the output 1, output 2, output 3, output 4, and output 5 of FIG. 1 may correspond to output ports 121, 122, 123, 124, and 125, respectively. In the embodiment shown in FIG. 2, output ports 122 and 124 are respectively connected to two ends of the first transmission line 127, and the output ports 121 and 125 are respectively connected to two ends of the second transmission line 128.

Figure 3:
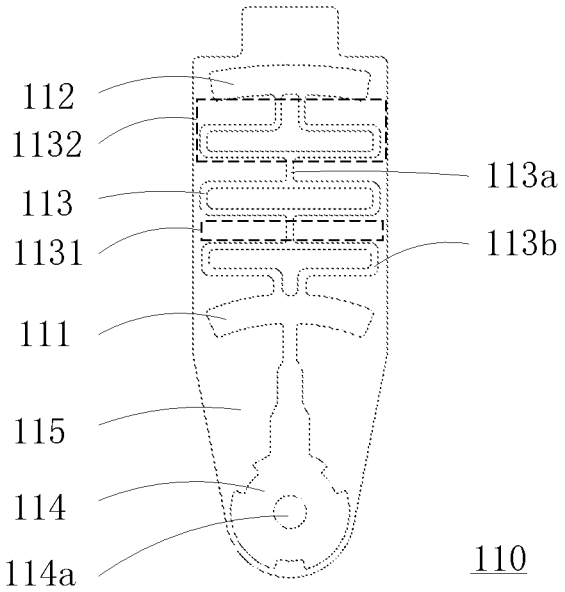
FIG. 3 is a schematic structural diagram showing a slider according to an exemplary embodiment of the present disclosure.

In some embodiments, the slider 110 may also be a printed circuit board that is configured to move relative to the stationary member 120. As shown in FIG. 3, the slider 110 may include a first substrate 115. A first coupling section 111, a second coupling section 112, and an impedance conversion line 113 are provided on the first substrate 115, where the impedance conversion line 113 is connected between the first coupling section 111 and the second coupling section 112. The slider 110 may further include a connection portion 114 connected to the first coupling section 111, and a first connection hole 114*a* may be provided in the connection portion 114. In some embodiments, the first coupling section 111, the second coupling section 112, the impedance conversion line 113, and the connection portion 114 may be integrally formed by a conductive material (for example, copper) to achieve signal coupling and transmission.

As shown in FIG. 2, the slider 110 may be slidably connected to the stationary member 120 by inserting a pin, rivet or the like through the first connection hole 114*a* and the second connection hole 129*a*. A surface of the slider 110, on which the first coupling section 111, the second coupling section 112, the impedance conversion line 113, and the connection portion 114 are provided, is directly opposite a surface of the stationary member 120, on which the first transmission line 127 and the second transmission line 128 are provided to facilitate signal coupling. After the slider 110 is connected to the stationary member 120, the first connection hole 114*a* is opposite to the second connection hole 129*a*, the first coupling section 111 overlaps a part of the first transmission line 127, and the second coupling section 112 overlaps a part of the second transmission line 128. As such, a signal in the phase shifter can be capacitively coupled between the first connection hole 114*a* and the second connection hole 129*a*, between the overlapping parts of the first coupling section 111 and the first transmission line 127, and between the overlapping parts of the second coupling section 112 and the second transmission line 128. The slider 110 can rotate around an axis passing through the first connection hole 114*a* and the second connection hole 129*a*. As the slider 110 slides relative to the stationary member 120, the first coupling section 111 will slide along the first transmission line 127 and the second coupling section 112 will slide along the second transmission line 128, thereby changing the phases of the portions of the RF signal that are coupled to the respective transmission lines 127, 128.

Specifically, during the operation of the phase shifter 100, the input signal enters the phase shifter 100 at the input port 126. This signal is passed to a junction where the input signal is split. A first portion of the input signal is passed to the output port 123 along a transmission line on the stationary member 120 for output, while the remainder of the input signal is capacitively coupled from the stationary member 120 into the slider 110 and is transmitted along a conductive trace on the slider 110. The portion of the input signal that is coupled to the slider 110 is passed to the first coupling section 111 and the second coupling section 112 along the slider 110. As the first coupling section 111 is coupled with a part of the first transmission line 127 on the stationary member 120, a part of the signal in the slider 110 is coupled to the first transmission line 127 where it is split into two sub-components that are passed to output ports 124 and 122, respectively. Similarly, as the second coupling section 112 is coupled with a part of the second transmission line 128 on the stationary member 120, another part of the signal in the slider 110 is coupled to the second transmission line 128 where it is split into two sub-components that are passed to output ports 125 and 121, respectively, of the stationary member 120. The phase difference between each sub-component of the RF signal that is output from the phase shifter 100 is mainly determined by the length of the first transmission line 127 or the second transmission line 128 through which the sub-component passes. When the position of the slider 110 relative to the stationary member 120 changes, the length of the first transmission line 127 from the left end of the first coupling section 111 to the output port 124, the length of the first transmission line 127 from the right end of the first coupling section 111 to the output port 122, the length of the second transmission line 128 from the left end of the second coupling section 112 to the output port 125, and the length of the second transmission line 128 from the right end of the second coupling section 112 to the output port 121 will change. As a result, the phase shift of the signal transmitted therein is changed, thereby generating output signals having different phases.

In the phase shifter 100, the amplitude of the sub-component of the RF signal that is directly output through output port 123 is usually greater than the amplitudes of the sub-components of the RF signal that are output at output ports 124 and 122. Due to the effect of the impedance conversion line 113, the amplitudes of the sub-components of the RF signal that are output at output ports 124 and 122 are greater than the amplitudes of the sub-components of the RF signal that are output at output ports 125 and 121. In order to increase the magnitude taper that is applied by the phase shifter 100, that is, to increase the difference between the amplitudes of the sub-components of the RF signal that are output at output ports 124 and 122 and the amplitudes of the sub-components of the RF signal that are output at output ports 125 and 121, the impedance of the impedance conversion line 113 connected between the first coupling section 111 and the second coupling section 112 can be increased.

In an exemplary embodiment of the present disclosure, as shown in FIG. 3, the impedance conversion line 113 may include a series portion 1131 and a parallel portion 1132 connected in series. A single series portion 1131 includes only one first connection line 113*a*, and a single parallel portion 1132 may include at least two second connection lines 113*b* connected in parallel. The arrangement of the series portion 1131 can help to increase the overall impedance of the impedance conversion line 113 to meet requirements on the magnitude taper of the phase shifter 100.

To be specific, the extension dimension of the impedance conversion line 113 may be configured according to an operating frequency band. For example, the equivalent length of the impedance conversion line 113 may be equivalent to a quarter of the wavelength of the signal so as to better transmit the signal therein.

In some embodiments, the impedance conversion line 113 may be symmetrical or substantially symmetrical with respect to an axis passing through the midpoint of the first coupling section 111 and the midpoint of the second coupling section 112. In other words, the phase shift introduced by the left half and the phase shift introduced by the right half of the impedance conversion line 113 are equal or substantially equal. When the slider 110 is at the center position of the stationary member 120, the signal output from the output port 125 and the signal output from the output port 121 are basically in the same phase. Similarly, the signal output from the output port 124 and the signal output from the output port 122 are basically in the same phase. As the slider 110 deviates from the center position of the stationary member 120, the phase difference between the signal output from the output port 125 and the signal output from the output port 121 becomes greater. Similarly, the phase difference between the signal output from the output port 124 and the signal output from the output port 122 becomes greater. In such a design, the phase of the signal output by each output port can be adjusted by relatively simply adjusting the position of the slider 110 on the fixing member 120.

In the present disclosure, the series portion 1131 and the parallel portion 1132 may have a plurality of different arrangements to meet different requirements.

In an exemplary embodiment shown in FIG. 3, the first connection line 113*a* extends linearly. An end portion of the first connection line 113*a* may be directly connected to the parallel portion 1132, or directly connected to the first coupling section 111 or the second coupling section 112.

In some embodiments, the first connection line 113*a* or its extended line may pass through the midpoint of the first coupling section 111 and the midpoint of the second coupling section 112 to maintain symmetry.

Figure 4:
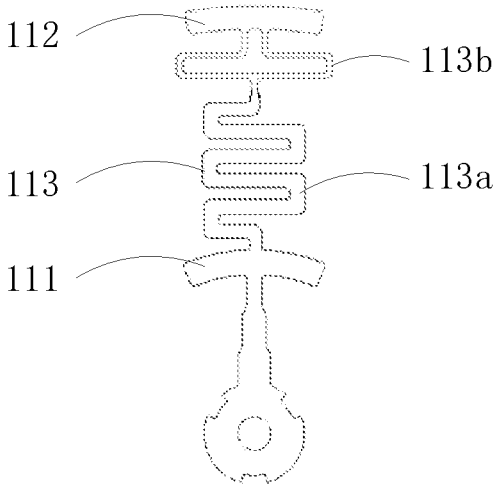
FIG. 4 is a schematic structural diagram showing a slider according to another exemplary embodiment of the present disclosure.

As shown in FIG. 4, in another exemplary embodiment of the present disclosure, the first connection line 113*a* may extend in a polygonal line shape in order to further increase the impedance of the series portion 113. By bending the first connection line 113*a*, the impedance of the series portion 1131 can be greatly increased in a limited space, thereby effectively increasing the impedance of the impedance conversion line 113.

In some embodiments, when the first connection line 113*a* extends in a polygonal line shape, adjacent first sub-connection lines extending in different directions of the first connection line 113*a* are chamfered and connected. In the present description, the first sub-connection line and a second sub-connection which will be described later are respectively segments extending linearly in the first connection line and the second connection line. By chamfering and connecting the adjacent first sub-connection lines, the maximum curvature in the first connection line 113*a* can be reduced, that is, the first connection line 113*a* can be prevented from being excessively bent. This is helpful in optimizing the passive intermodulation performance, thereby improving the signal transmission performance of the slider 110.

In some embodiments, adjacent first sub-connection lines extending in different directions of the first connection line 113*a* are perpendicular to each other. Moreover, the first sub-connection line may extend along the axis direction of the slider 110 or extend along a direction perpendicular to the axis to make full use of a wiring space in the slider 110. Of course, in other embodiments, adjacent first sub-connection lines extending in different directions of the first connection line 113*a* may form other angles.

In some embodiments, the first connection line 113*a* may also extend in a curved line shape to further help to reduce the maximum curvature in the first connection line 113*a* and improve the passive intermodulation performance, thereby improving the signal transmission performance of the slider 110.

In an exemplary embodiment shown in FIG. 3, the parallel portion 113*b* [sic: 1132] includes two second connection lines 113*b* that are connected in parallel, wherein an end portion of the second connection line 113*b* may be directly connected to the series portion 1131 or directly connected to the first coupling section 111 or the second coupling section 112.

In other embodiments, the parallel portion 113*b* [sic: 1132] may include more that two second connection lines 113*b* that are connected in parallel. By changing the number of the second connection lines 113*b* in the parallel portion 113*b* [sic: 1132] and adjusting parameters such as the line width of the first connection line 113*a* and/or the second connection line 113*b* in some embodiments in combination, the range of the signal amplitude that can be generated by the phase shifter 100 can be expanded to meet various needs.

As shown in FIG. 3 and FIG. 4, in some embodiments, the second connection line 113*b* may have a polygonal line shape. In addition, adjacent second sub-connection lines extending in different directions of the second connection line 113*b* may be chamfered and connected to reduce the maximum curvature in the second connection line 113*b*, that is, to avoid excessive bending of the second connection line 113*b*. This is helpful in reducing passive intermodulation distortion. Adjacent second sub-connection lines extending in different directions of the second connection line 113*b* may be perpendicular to each other. Moreover, the second sub-connection line may extend along the axis direction of the slider 110 or extend along a direction perpendicular to the axis to make full use of the wiring space in the slider 110. Of course, in some other embodiments, adjacent second sub-connection lines extending in different directions of the second connection line 113*b* may form other angles.

In some embodiments, for example, as shown in FIG. 3, the series portion 1131 and the parallel portion 1132 are arranged alternately. In other words, a large impedance part and a small impedance part of the impedance conversion line 113 alternate with each other to form a step impedance, so that the amplitude of the output signal remains stable and basically does not change as the frequency changes.

Specifically, the number of bends in a single second connection line 113*b* may be equal to or less than 3. For example, the number of bends in the second connection line 113*b* directly connected to the first coupling section 111 and the second coupling section 112 may be 3; the number of bends in the second connection line 113*b*, with both ends being directly connected to the first connection line 113*a*, may be 2, as shown in FIG. 3 and FIG. 4. The aforementioned requirement can be achieved in the following manners: The second sub-connection line of the second connection line 113*b* directly connected to the first coupling section 111 or the second coupling section 112 may extend along the direction of an axis passing through the midpoint of the first coupling section 111 and the midpoint of the second coupling section 112. The second sub-connection line of the second connection line 113*b* directly connected to the first connection line 113*a* may extend along a direction perpendicular to the axis passing through the midpoint of the first coupling section 111 and the midpoint of the second coupling section 112.

In some embodiments, the second connection line 113*b* may also extend in a curved line shape to further help to reduce the maximum curvature in the second connection line 113*b* and improve the passive intermodulation performance, thereby improving the signal transmission performance of the slider 110.

Figure 5:
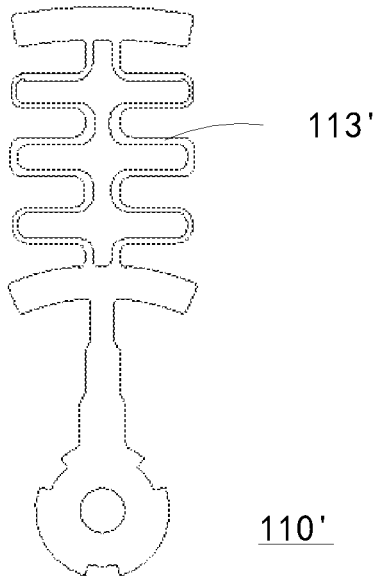
FIG. 5 is a schematic structural diagram of a slider.
Figure 6A:
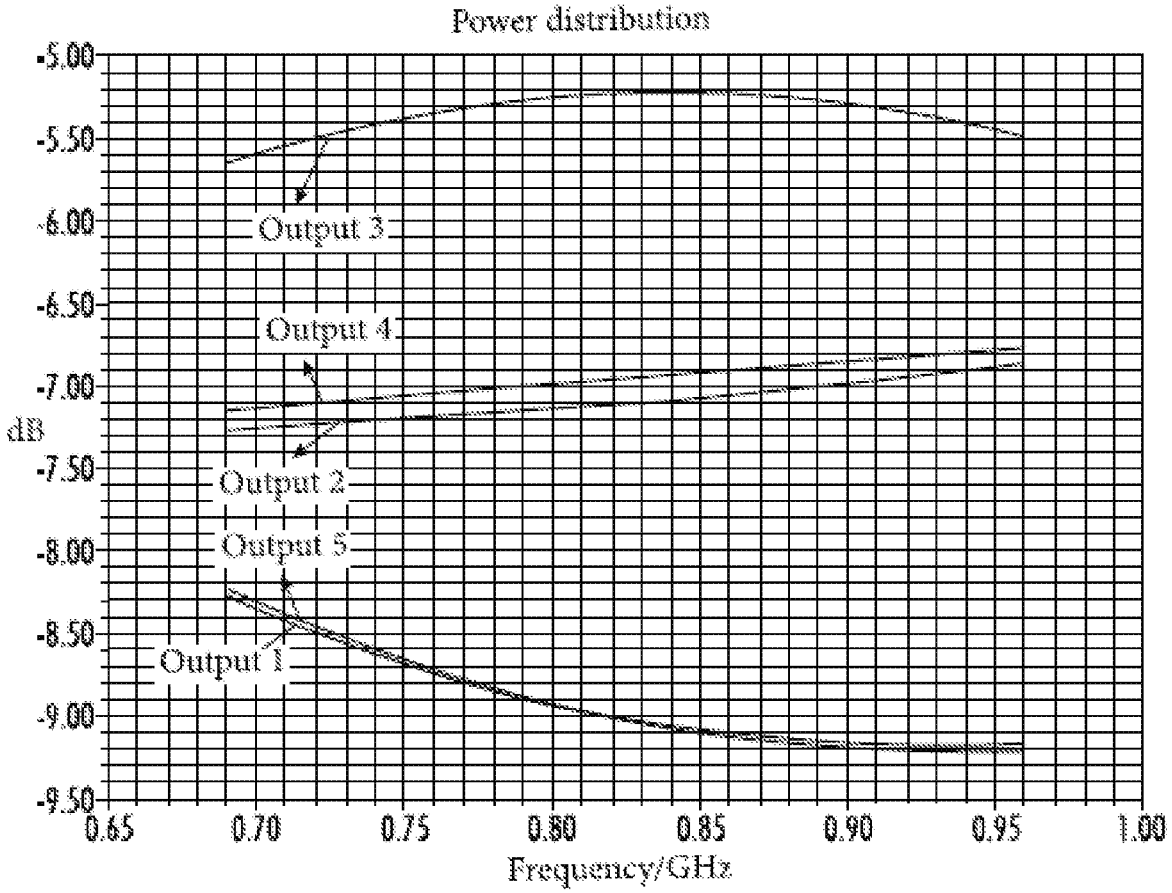
FIG. 6(*a*) is a diagram showing the power distribution of a phase shifter including the slider in FIG. 4.
Figure 6B:
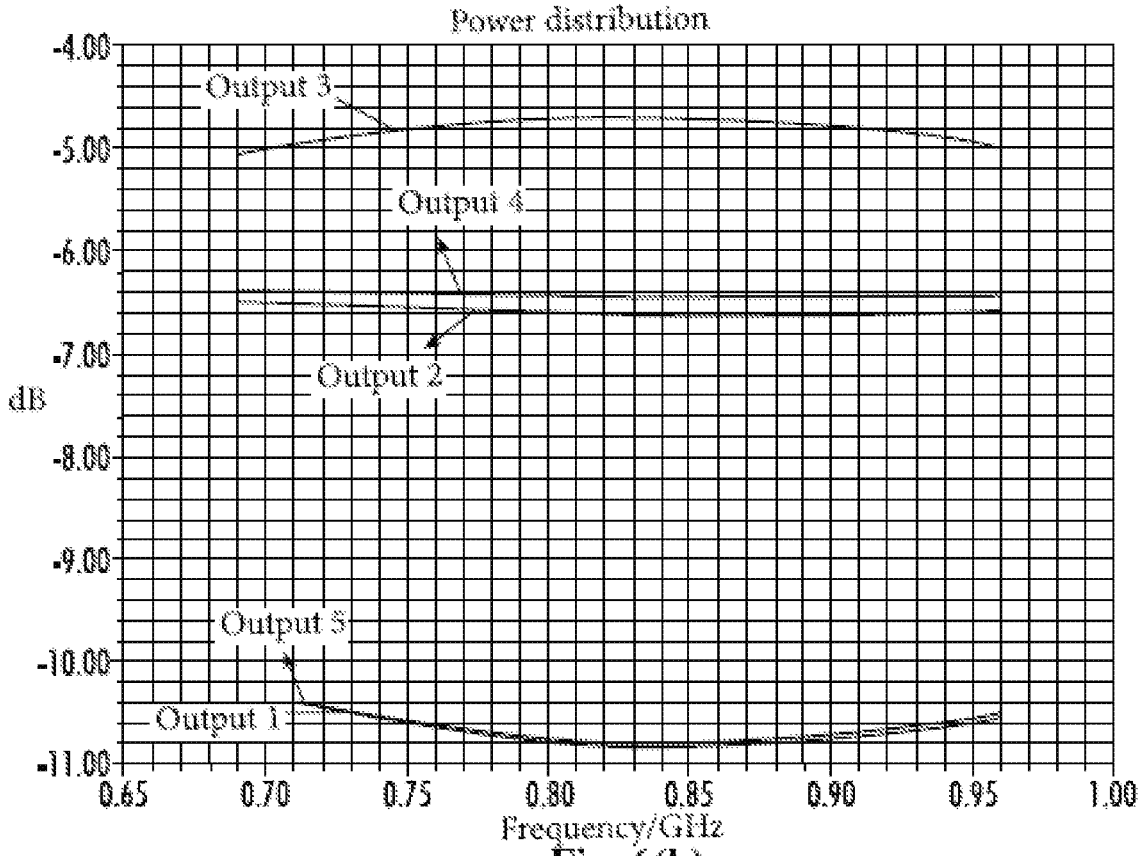
Figure 7A:
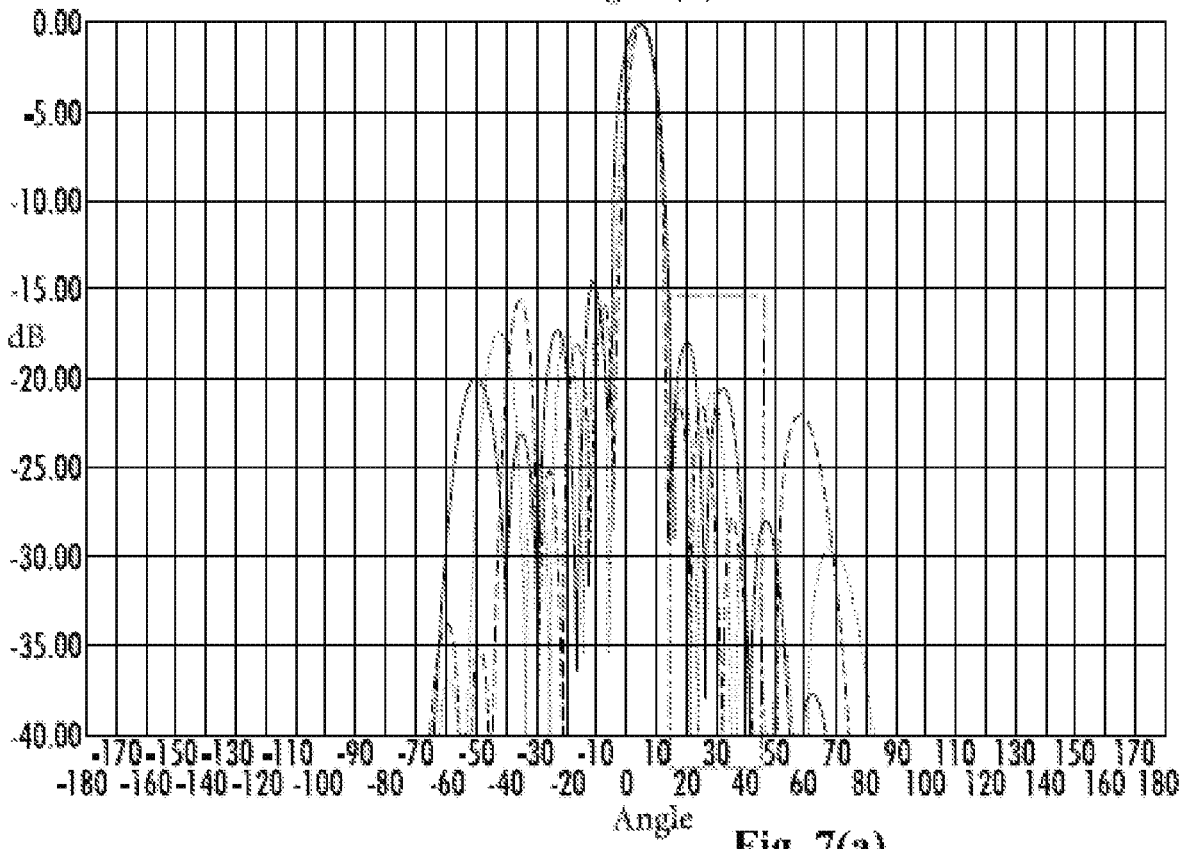
FIG. 7(*a*) is an azimuth pattern showing radiation signals of a base station antenna including the slider in FIG. 4.
Figure 7B:
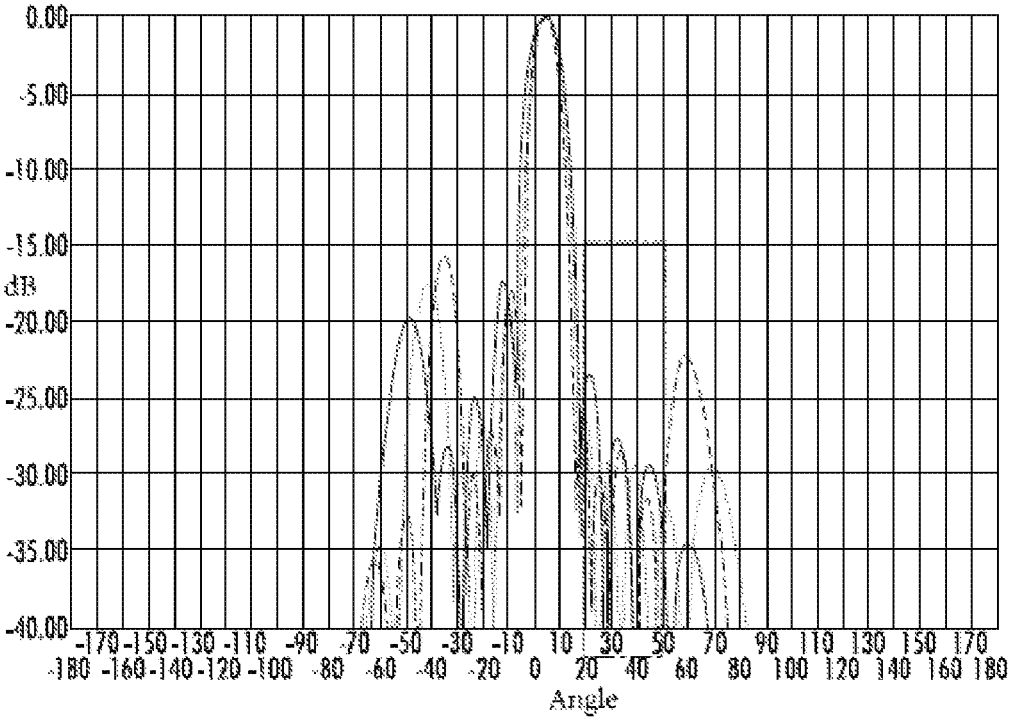

FIG. 6(*a*) to FIG. 7(*b*) compare related performances of a phase shifter and a base station antenna based on the sliders of FIG. 3 and FIG. 5.

As shown in FIG. 5, in a slider 110', an impedance conversion line 113' may include two connection lines connected in parallel. In this case, generally, the impedance of the impedance conversion line 113' is adjusted by changing the line width of the connection line. Generally, in order to ensure the performance and reliability of the phase shifter 100, the line width of the connection line is 0.65 mm or greater, for example, 0.7 mm. However, in the specific example shown in FIG. 5, the line width of the connection line is reduced to 0.4 mm or less to increase the impedance in order to obtain a desired magnitude taper.

FIG. 6(*a*) and FIG. 6(*b*) are power distribution diagrams of the output signals of each output port in a phase shifter using the sliders shown in FIG. 5 and FIG. 3, respectively. It can be seen that by introducing the series portion 1131, the difference between the signal amplitude of the outputs 1 and 5 and the signal amplitude of the outputs 2 and 4 increases, thereby increasing the magnitude taper of the phase shifter. In addition, after the series portion 1131 is introduced, the change of the amplitude of each output signal becomes smaller as a function of frequency, that is, the power distribution becomes flatter, which is helpful in improving the stability of the phase shifter.

FIG. 7(*a*) and FIG. 7(*b*) are azimuth patterns of base station antennas corresponding to the phase shifters using the sliders shown in FIG. 5 and FIG. 3, respectively. It can be seen that by introducing the series portion 1131, the sidelobe level of the radiation signal can be significantly reduced (as shown in the dashed line box), thereby improving the radiation performance of the base station antenna.

In the embodiments of the present disclosure, by providing the series portion and the parallel portion connected in series with each other in the impedance conversion line of the slider, the impedance of the impedance conversion line can be adjusted in a larger range, without relying on changing the line width to change the impedance. Therefore, the technical solutions of the present disclosure can effectively avoid problems such as decreased passive intermodulation performance, increased risk of high power, increased manufacturing difficulty and cost, and decrease in reliability caused by a line width being too small. The technical solutions of the present disclosure can adjust the impedance by changing the arrangements of the series portion and the parallel portion, and improve the flatness of the power distribution and increase the magnitude taper of the phase shifter at the same time, thereby helping to improve the radiation performance of the base station antenna.

The present disclosure further provides a base station antenna, and the base station antenna may include the slider or phase shifter described in the above embodiments.

As used herein, the words "front", "rear", "top", "bottom", "above", "below", etc., if present, are used for descriptive purposes and are not necessarily used to describe constant relative positions. It should be understood that the terms used in this way are interchangeable under appropriate circumstances, so that the embodiments of the present disclosure described herein, for example, can be operated on other orientations that differ from those orientations shown herein or otherwise described.

As used herein, the word "exemplary" means "serving as an example, instance, or illustration" rather than as a "model" to be copied exactly. Any realization method described exemplarily herein is not necessarily interpreted as being preferable or advantageous over other realization methods. Furthermore, the present disclosure is not limited by any expressed or implied theory given in the above technical field, background art, summary of the invention or embodiments.

As used herein, the word "basically" means including any minor changes caused by design or manufacturing defects, device or component tolerances, environmental influences, and/or other factors. The word "basically" also allows the gap from the perfect or ideal situation due to parasitic effects, noise, and other practical considerations that may be present in the actual realization.

In addition, the above description may have mentioned elements or nodes or features that are "connected" or "coupled" together. As used herein, unless specified otherwise, "connect" means that an element/node/feature is electrically, mechanically, logically connected, or connected in other manners (or communicated) with another element/node/feature. Unless explicitly stated otherwise, "coupled" means that one element/node/feature can be mechanically, electrically, logically or otherwise connected with another element/node/feature in a direct or indirect manner to allow interaction, even though the two features may not be directly connected. That is, "coupled" is intended to comprise direct and indirect connection of components or other features, including connection using one or a plurality of intermediate components.

In addition, for reference purposes only, "first", "second" and similar terms may also be used herein, and thus are not intended to be limitative. For example, unless the context clearly indicates, the words "first", "second" and other such numerical words involving structures or elements do not imply a sequence or order.

It should also be noted that, as used herein, the words "include", "contain", "have", and any other variations indicate that the mentioned features, entireties, steps, operations, elements and/or components are present, but do not exclude the presence or addition of one or more other features, entireties, steps, operations, elements, components and/or combinations thereof.

In the present disclosure, the term "provide" is used in a broad sense to cover all ways of obtaining an object, so "providing an object" includes but is not limited to "purchase", "preparation/manufacturing", "arrangement/setting", "installation/assembly", and/or "order" of the object, etc.

Those skilled in the art should realize that the boundaries between the above operations are merely illustrative. A plurality of operations can be combined into a single operation, which may be distributed in the additional operation, and the operations can be executed at least partially overlapping in time. Also, alternative embodiments may include a plurality of instances of specific operations, and the order of operations may be changed in other various embodiments. However, other modifications, changes and substitutions are also possible. Therefore, the description and drawings hereof should be regarded as illustrative rather than restrictive.

Although some specific embodiments of the present disclosure have been described in detail through examples, those skilled in the art should understand that the above examples are only for illustration rather than for limiting the scope of the present disclosure. The embodiments disclosed herein can be combined arbitrarily without departing from the spirit and scope of the present disclosure. Those skilled in the art should also understand that various modifications can be made to the embodiments without departing from the scope and spirit of the present disclosure. The scope of the present disclosure is defined by the attached claims.

That which is claimed is:

1. A slider, comprising:

a first coupling section;

a second coupling section; and an impedance conversion line connected between the first coupling section and the second coupling section, the impedance conversion line including a series portion and a parallel portion which are connected in series, wherein the series portion includes only one first connection line, and the parallel portion includes at least two second connection lines connected in parallel, and wherein the first connection line extends in one of a polygonal line shape and a curved line shape.

2. The slider according to claim 1, wherein the slider further includes a first substrate, and the first coupling section, the second coupling section, and the impedance conversion line are provided on the first substrate.

3. The slider according to claim 1, wherein the first connection line extends linearly.

4. The slider according to claim 3, wherein the first connection line or an axis defined by the first connection line passes through a midpoint of the first coupling section and a midpoint of the second coupling section.

5. The slider according to claim 1, wherein the first connection line extends in the polygonal line shape, and wherein adjacent first sub-connection lines extending in different directions of the first connection line are chamfered and connected.

6. The slider according to claim 1, wherein the first connection line extends in the polygonal line shape, and wherein adjacent first sub-connection lines extending in different directions of the first connection line are perpendicular to each other.

7. The slider according to claim 1, wherein the second connection line extends in the polygonal line shape.

8. The slider according to claim 7, wherein adjacent second sub-connection lines extending in different directions of the second connection line are chamfered and connected.

9. The slider according to claim 7, wherein adjacent second sub-connection lines extending in different directions of the second connection line are perpendicular to each other.

10. The slider according to claim 1, wherein the second connection line extends in the curved line shape.

11. The slider according to claim 1, wherein the impedance conversion line is symmetrical with respect to an axis passing through a midpoint of the first coupling section and a midpoint of the second coupling section.

12. The slider according to claim 1, wherein the series portion and the parallel portion are alternately arranged to form a step impedance.

13. The slider according to claim 1, wherein the impedance conversion line has an extension dimension configured according to an operating frequency band.

14. The slider according to claim 1, wherein the impedance conversion line has a line width of at least 0.65 mm.

15. The slider according to claim 1, wherein the impedance conversion line includes at least two series portions and at least two parallel portions, where each series portion is connected in series to at least one of the parallel portions.

16. A phase shifter, comprising:

a stationary member; and the slider according to claim 1, wherein the slider is slidably connected to the stationary member.

17. The phase shifter according to claim 16, wherein the slider includes a connection portion connected to the first coupling section, and a first connection hole is provided on the connection portion;

the stationary member includes a second substrate, and a second connection hole is provided on the second substrate;

wherein the slider and the stationary member are rotatably connected to each other through the first connection hole and the second connection hole.

18. The phase shifter according to claim 17, wherein the stationary member further includes a first transmission line and a second transmission line provided on the second substrate;

wherein the first coupling section overlaps and is coupled with a part of the first transmission line, and the first coupling section is slidable along the first transmission line; the second coupling section overlaps and is coupled with a part of the second transmission line, and the second coupling section is slidable along the second transmission line.

19. A slider, comprising:

a first coupling section;

a second coupling section; and an impedance conversion line connected between the first coupling section and the second coupling section, the impedance conversion line including a series portion and a parallel portion which are connected in series, wherein the series portion includes only one first connection line, and the parallel portion includes at least two second connection lines connected in parallel, and wherein each of the at least two second connection lines extend in a curved line shape.

20. A slider, comprising:

a first coupling section;

a second coupling section; and an impedance conversion line connected between the first coupling section and the second coupling section, the impedance conversion line including at least two series portions and at least two parallel portions, where each series portion is connected in series to at least one of the parallel portions, wherein the series portion includes only one first connection line, and wherein each of the at least two parallel portions includes at least two second connection lines connected in parallel.

* * * * *